United States Patent [19]

Pfalzgraf et al.

[11] Patent Number: 4,896,640

[45] Date of Patent: Jan. 30, 1990

[54] LOAD SETTING DEVICE

[75] Inventors: Manfred Pfalzgraf, Frankfurt am Main; Gerd Hickmann, Kirchen, both of Fed. Rep. of Germany

[73] Assignee: VDO Adolf Schindling AG, Frankfurt am Main, Fed. Rep. of Germany

[21] Appl. No.: 221,989

[22] Filed: Jul. 20, 1988

[30] Foreign Application Priority Data

Jul. 23, 1987 [DE] Fed. Rep. of Germany ..... 3724338
May 7, 1988 [DE] Fed. Rep. of Germany ..... 3815734

[51] Int. Cl.[4] ..... F02D 11/10
[52] U.S. Cl. ..... 123/399; 123/361
[58] Field of Search ..... 123/342, 361, 396, 399

[56] References Cited

U.S. PATENT DOCUMENTS 4,791,902 12/1988 Ishikawa et al. ..... 123/399

FOREIGN PATENT DOCUMENTS 3146652 6/1983 Fed. Rep. of Germany ..... 123/399
122742 7/1984 Japan ..... 123/399

*Primary Examiner*—Tony M. Argenbright
*Attorney, Agent, or Firm*—Martin A. Farber

[57] ABSTRACT

A load setting device having a control element (11) which acts on a setting member (16) which determines the power of an internal combustion engine, which control element is connected to a driver (4) coupled to an accelerator pedal (1) and in addition can be moved by means of an electric actuator (9), having a desired-value detection element (7) associated with the driver (4), an actual-value detection element (12) cooperating with said desired-value detection element and acting on the electric actuator (9), the electric actuator (9) being controllable as a function of the detected values by an electronic control device (22). The driver (4) and the control element (11) are coupled by means of a coupling spring (13) and the control element (11) is urged in the direction towards a stop (14) of the driver (4).

17 Claims, 3 Drawing Sheets

LOAD SETTING DEVICE

FIELD AND BACKGROUND OF THE INVENTION

The present invention relates to a load setting device having a control element (11) which can act on a setting member (16) which determines the power of an internal combustion engine, the control element being connected to a driver (4) coupled to an accelerator pedal (1) and being furthermore movable by means of an electric servomotor (9), having a desired-value detection element (7) associated with said driver (4), an actual-value detection element (12) which cooperates with said desired-value detection element (7) and acts on the electric actuator (9), the actuator (9) being adapted to be controlled as a function of the detected values by an electronic control device (22).

Load setting devices of this type are provided in automotive vehicles for actuating the throttle valve or the injection pump by means of the accelerator pedal, so as to be able to intervene by means of the electronic control device in such a manner that, for instance, wheel spinning upon starting as a result of excessive power is avoided. The control device can see to it that, for instance, upon too rapid a depressing of the accelerator pedal, the throttle valve is opened less than corresponds to the position of the accelerator pedal, so that the internal combustion engine produces only an output which does not lead to the spinning of the wheels. Other automatic interventions of the load setting device are necessary if a gear is to be shifted automatically or if the idling speed of rotation is to be brought to a constant value even in the case of different requirements as to power upon idling It is also known in the case of such a setting device to intervene by means of a speed-limiting controller which, by the possibility of disengaging the control element from the accelerator pedal, can see to it in each case that that power is set which is necessary in order to maintain the speed which has been set. In addition, it may be desirable from the standpoint of driving comfort to provide a progressive or degressive coupling of the accelerator pedal with the possibility of a power setting which is reduced or increased compared to the accelerator position Considerations of safety make it necessary, however, that upon release of the position of the accelerator pedal, there is assurance, even in the event of a defect in the control device, that the power set decreases synchronously with the position of the accelerator pedal. This has been achieved up to now by safety devices in the electronic control device. Possibilities of error in the control electronics are reduced by building the electronic system in redundant fashion. Nevertheless, too high a power setting which is not in accord with the position of the accelerator pedal cannot be completely excluded in the event of a defect.

Load setting devices of the aforementioned type are generally developed of a plurality of parts, i.e. certain elements are associated with the accelerator pedal while other elements cooperate with the control element Such a separate arrangement of the component parts results, on the one hand, in an increased size of the load setting device while, on the other hand, due to the arrangement of the parts at different places of the vehicle, assurance is not provided that the parts cooperate, without retroactive effect, with the throttle valve or the injection pump.

SUMMARY OF THE INVENTION

It is an object of the invention to develop a load setting device of the aforementioned kind in such a manner that it is of compact development and makes possible under all conditions of load, particularly in the event of failure of the electronic control device, a well-defined reaction on the setting member and thus the throttle valve or injection pump.

According to the invention, the driver (4) and the control element (11) are coupled by means of a coupling spring (13) and the control element (11) is biased in the direction towards a stop (14) of the driver (4).

By the arrangement of driver, coupling spring, control element, desired-value detection element and actual-value detection element in the direct active chain, assurance is had that control processes can take place between the parts in minimum space and furthermore, by the arrangement of the parts in the region of the setting member of the internal combustion engine, assurance is had that the active chain acts directly in the region of the internal combustion engine. Thus, for instance, the accelerator pedal can act via a Bowden cable directly on the driver which is arranged in the region of the setting member of the internal combustion element and is urged by another spring in the idling direction, the position of the driver is represented by the desired-value detection element and the position of the control element by the actual-value detection element, and the values detected by the two elements are forwarded to the electronic control device which controls the control element cooperating with the setting member via the electrical actuator in a manner corresponding to the control characteristic preestablished between the two elements. The coupling spring makes certain in this connection that in the event of diverging movements of driver and control element a failure of the electronic control device leads in all cases to a change in the power setting to a value which corresponds to the position of the accelerator pedal.

In accordance with a special embodiment of the invention the control element (11) contains a control lever (21) and, in particular in the case of a development of the setting member as throttle valve, the control element encloses the bearing shaft of the throttle valve to which the control lever is connected, fixed for rotation. The possibility thus is afforded of having the coupling spring act on the one end on the driver and at the other end on the bearing shaft, in which connection the control lever then cooperates with the stop on the driver.

In accordance with one particular embodiment of the invention, the driver (4), the coupling spring (13), the control element (11), the desired-value detection element (7) and the actual-value detection element (12) form a single structural unit.

If the setting member of the internal combustion engine is developed, for instance, as throttle valve (16), then the structural unit can furthermore form a unit with the throttle valve housing (24); it is furthermore conceivable for the further spring to be also integrated in the structural unit.

Further according to a feature of the invention, the further spring (6) urges the driver (4) in idling direction.

In accordance with one particular embodiment of the invention, the driver (4) is developed in two parts, with a first part (4*a*) which is coupled with the accelerator pedal (1) and is associated with the desired-value detection element (7) and a second part (4*b*) which is movable relative to the first part (4*a*) and bears the stop (14) and is associated with the control lever (11), the second part (4*b*) being connected to the control element (11) by means of the coupling spring (13). By the two-part development there is possible independent movement of the first part associated with the desired-value detection element with respect to the second part associated with the control element, and thus an upward regulating function, in which connection upon the upward regulation the distance monitoring device which is possibly present is deactivated and the second part of the driver is displaced via the control element against the force of the further spring relative to the first part of the driver which is coupled with the accelerator pedal, and this spring sees to it that upon failure of the electronic control device, the driver and the control element are guided in geometrically defined manner with respect to each other.

It is a feature of the invention that the further spring (6) acts on the second part (4*b*) of the driver (4).

The load setting device of the invention can, for instance, operate with a potentiometer; the desired-value detection element (1) is in this connection advisedly developed as first wiper (7) of the two-wipers (7, 12) of the command and report potentiometer (8) the actual-value detection element (12) of which in the form of the second wiper (12) is coupled with the control element (11), the distance apart of the wipers (7,12) being monitored by means of the electronic control device (22).

It would be conceivable that, despite separation of the electric actuator, the coupling spring which urges the driver in the idling direction and also the further spring are not able, as a result of a jamming of structural parts, to move the driver in the idling direction. Such an error can readily be noted in the manner that a pedal contact switch (18) by which the exertion of force on the accelerator pedal by the driver can be noted is provided on the accelerator pedal (1).

In accordance with a special embodiment of the invention, the coupling spring is developed as a coil spring (13). It can thus be installed in a very small space, for instance, when the setting member is developed as throttle valve, around the shaft of the throttle valve.

It is of particular importance in connection with the load-setting device of the invention that all elements of the load-setting device which act via an electronic circuit on the control element are deactivated upon failure of the electrical system so that the load-setting device operates mechanically via the coupling of driver and control element by means of the coupling spring. Thus it is provided that the control electronics (electronic control device 22) is disconnected in the voltage-free state of the load-setting device. The same applies with regard to an electric actuator (9), which should advisedly be adapted for connection via a clutch (10) to the control element (11), the clutch (10) should be open in voltage-free (not actuated) condition of the electric actuator (9). In principle, however, it is not necessary for a clutch to be provided, but with direct coupling of the electric actuator with the control element it would then be necessary, in case of failure of the electronic control device, for the further spring to be so amply dimensioned that it can move the electric actuator, whereby reactions on the driver and the accelerator pedal cannot be excluded.

In accordance with a special embodiment of the invention, it is provided that the electric actuator (9) can be controlled as a function of one or more additional control variables. One additional control variable, for instance, can be the speed of rotation of the engine, particularly the idling speed of rotation. In addition, there are of particular importance control variables which refer to altitude pressure, cold start and thus the engine temperature, the gear position and thus the condition of load of the vehicle, the push operation and thus indirectly the speed of the vehicle; furthermore control variables can also result from the speed control governor setting, the antislip regulation and thus the detection of the wheel speed of rotation as well as the regulation of the motor pulling-moment control.

In accordance with a special embodiment of the invention, there is provided between the stop (14) and the control element (11), in particular the control lever (21), a distance monitoring device (15) which, when a predetermined spacing of the electronic control device (22) is dropped below, feeds a signal for the purpose of plausibility testing. Along this line, the electronic control device (22) can disconnect the electric actuator (9) in case of the presence of the signal and defined plausibility conditions insofar as it is connected with the control element by a clutch or, if this is not the case, disconnect directly.

The distance monitoring device (15) should in this connection, in the event that a predetermined distance is dropped below, open a safety contact (17) which removes current from the clutch (10) and thereby opens it.

The safety contact (17) preferably has a bridging line with a switch which opens or closes upon the presence of additional control variables. By the distance monitoring device there is created an additional, substantially mechanically operating redundance which is independent of the electronic control device, so that a particularly high degree of reliability against an undesired power setting is present. The distance monitoring device is deactivated if, contrary to the wish of the driver, an upwardly regulating load function is to be produced and in this upwardly regulated load state only again activated if the electronic control device should fail, as a result of which the load level is again adapted via the coupling spring to the level predetermined by the accelerator pedal.

BRIEF DESCRIPTION OF THE DRAWING

With the above and other objects and advantages in view, the present invention will become more clearly understood in connection with a detailed description of preferred embodiments, when considered with the accompanying drawing, of which.

DETAILED DESCRIPTION OF THE PREFERRED EMBODIMENTS

Figure 1:
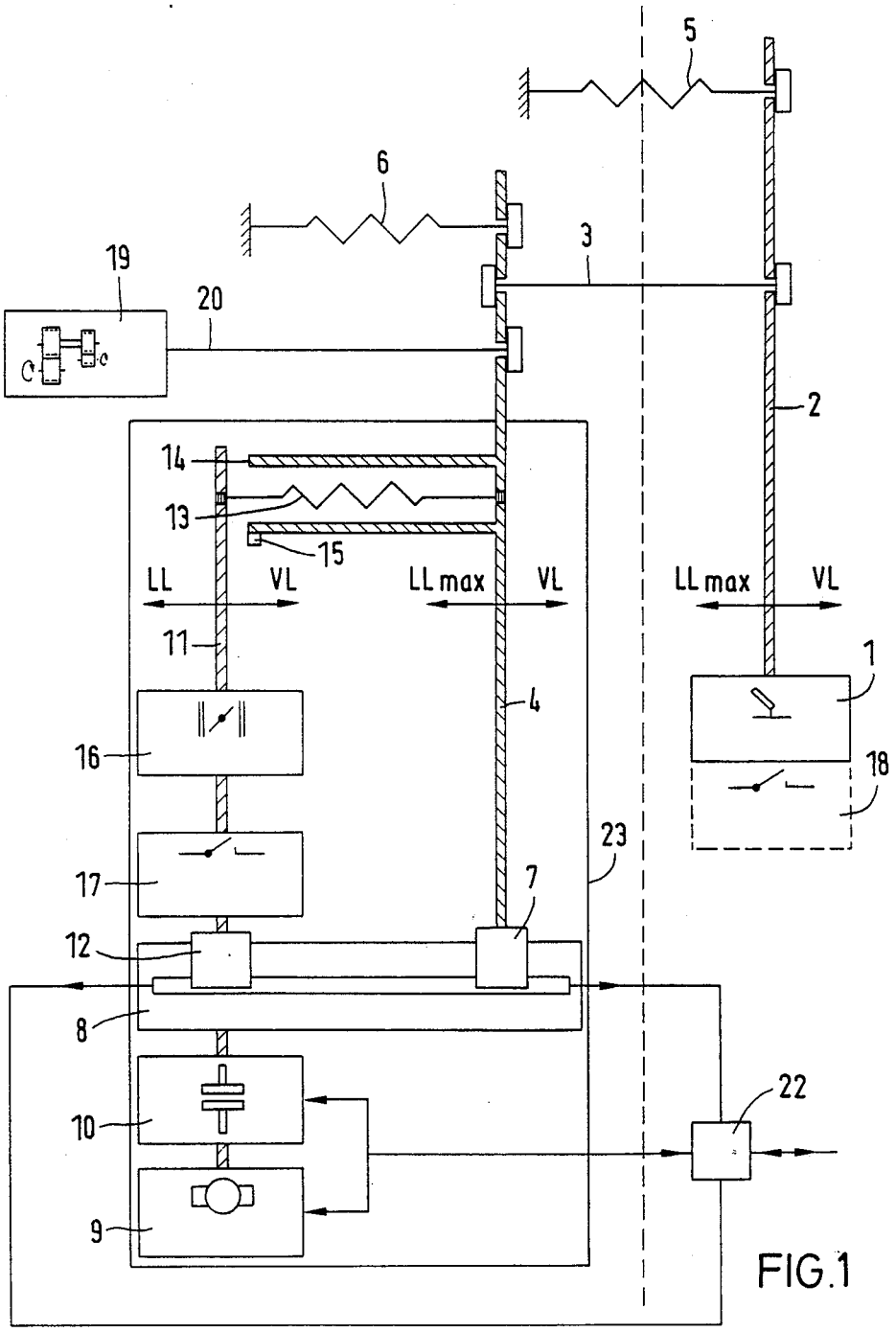
FIGS. 1 and 2 are basic diagrams in the form of block diagrams of single-part and double-part drivers respectively.

FIG. 1 shows an accelerator pedal 1 by which a lever 2 can be displaced between a full load position VL and an idling position with maximum idling output LLmax. Via a rod 3 the lever 2 can shift a single-part driver 4 in the full-load direction VL and is urged by a return spring 5 which acts on the lever 2 into the idling position. A reset spring 6 urges the driver 4 in the idling direction. The driver 4 is connected to a desired-value detection element in the form of a wiper 7 of a potentiometer 8 which controls a servomotor 9 which is capable of displacing a control lever 11 via a clutch 10. The control lever 11 serves directly for the displacement of a throttle valve 16 or a fuel injection pump (not shown). The position of this control lever 11 is transmitted via an actual -value detection element in the form of a second wiper 12, firmly connected to it, to the potentiometer 8. If the control lever 11 precisely follows the command given by the accelerator pedal 1, then the distance apart of the wipers 7, 12 must remain constant.

With the wipers 7 and 12 of the potentiometer 8 there cooperates an electronic control device 22 which inter alia controls the electric servomotor 9 and the clutch 10. As a result of the possibility of representing external command values by the control device 22, the control element 11 can be moved independently of the driver 4.

For the contingency of a failure of the electronic system, a mechanical connection is provided between the driver 4 and the control element 11 by means of a coupling spring 13 which urges the control element 11 in the direction towards a stop 14 of the driver 4. The distance between the stop 14 and the control lever 11 is shown exaggeratedly large in the figure and is small when the load setting device is operating properly and is monitored by a distance monitoring device 15, which may be a simple limit switch. If the electronic system fails, the driver 4, after overcoming the small distance between stop 14 and control element 11, can shift the latter into the idling position.

By the box 23 shown in FIG. 1 it is intended to indicate that the driver 4, the coupling spring 13, the control element 11 as well as the potentiometer 8 together with the two wipers 7 and 12 represent one structural unit, and the throttle valve 16 arranged within the box 23 shows furthermore that the said parts at the same time form a structural unit with the throttle valve housing.

Finally there is of importance in the variant shown in FIG. 1 the arrangement of a safety contact 17 which cooperates with the clutch 10. In this way even a slight reduction in the spacing is an indication that the throttle valve 16 is opened more than corresponds to what was stipulated by the driver. This fact is noted by the distance monitoring device 15 and has the result that the safety contact 17 opens, which leads to the opening of the clutch 10. On the other hand, if, contrary to the desire of the driver, an upward regulating load function is desired, then the distance monitoring device 15 is deactivated so that the control element 11 can drive the driver 4 in the full-load direction without the safety contact 17 opening.

For the event that, after the release of the accelerator pedal 1, the driver 4 and the control lever 11 should not move in the idling direction, there is provided on the accelerator pedal 1 a pedal contact switch 18 via which such a faulty condition can be noted.

For the sake of completeness, the drawing also shows an automatic transmission 19 in connection with which, via the driver 4, an automatic pull 20 can be displaced.

Figure 2:
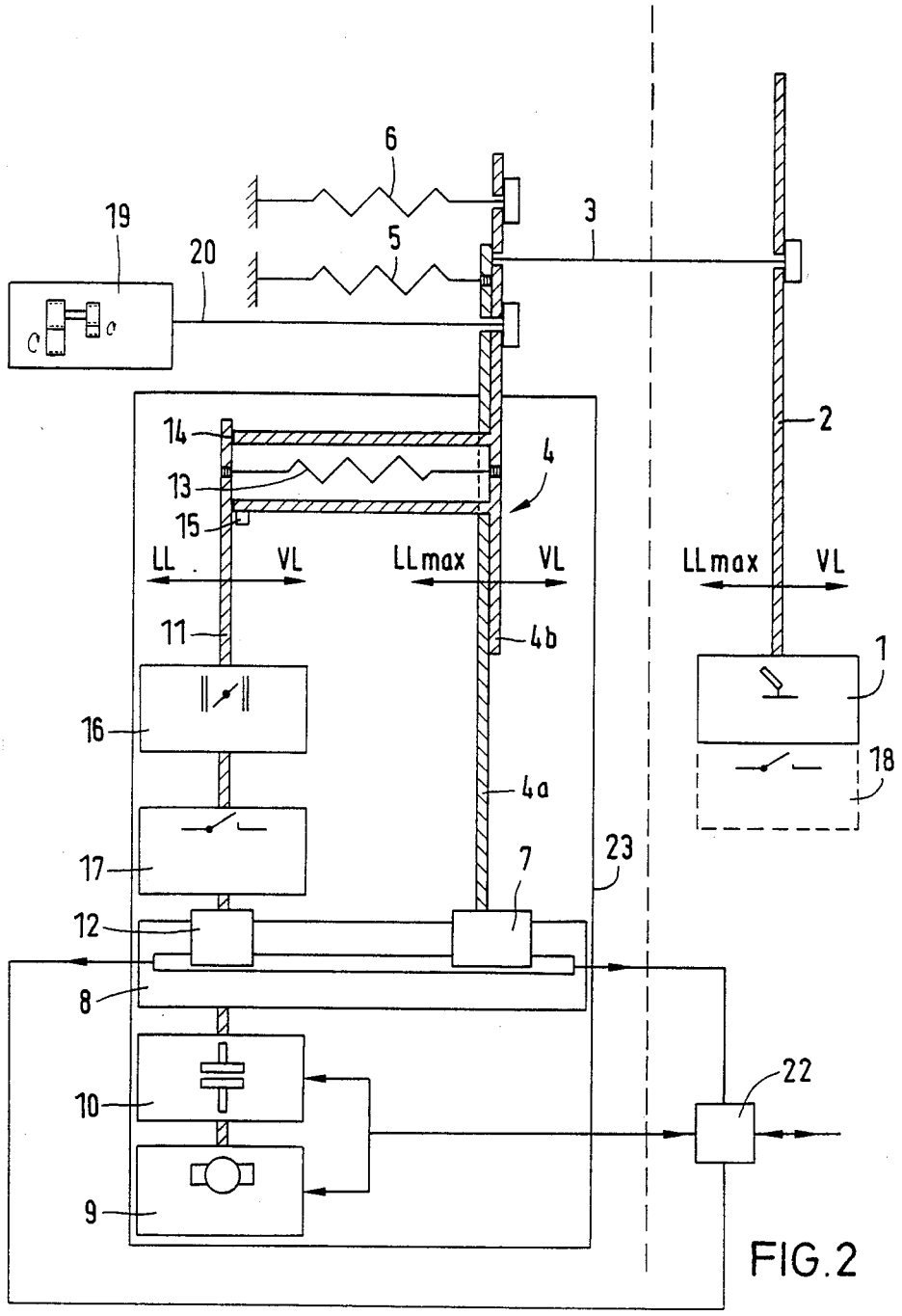

FIG. 2 shows a load setting device which is substantially identical to the showing in FIG. 1 but in which, however, the driver 4 consists of two parts 4*a* and 4*b*. Parts which agree in their function with the embodiment in accordance with FIG. 1 have been provided with the same reference numbers for the sake of simplicity.

The figure shows the first part 4*a* of the driver 4; the return spring 5 acts directly on the former. The part 4*a* can be displaced in the full load direction VL via the rod 3 by means of the lever 2 associated with the accelerator pedal 1 and is connected to the wiper 7 of the potentiometer 8. Relative to the first part 4*a*, the second part 4*b* of the driver 4 is movable against the force of the coupling spring 13, which spring acts in this connection on the control element 11 and on the second part 4*b* and attempts to pull it in the idling direction against the first part 4*a*. The return spring 6 again urges the entire driver 4 in the idling direction. In the load range which is regulated down as compared with the desire of the driver, the load-setting device, in accordance with the embodiment of FIG. 2, operates in exactly the same manner as that shown in FIG. 1. In the upwardly regulated control load range, on the other hand, with the distance monitoring device 15 deactivated, only the second part 4*b* of the driver 4 is displaced while the first part 4*a*, which correlates with the position of the accelerator pedal 1, remains in this position. Should the control electronics fail, this has the result that the return spring 6, after the disengagement of the clutch 10, pulls the second driver part 4*b* back in idling direction so that it rests against the first driver part 4*a* until the lower load established by the accelerator pedal 1 is reached.

Figure 3:
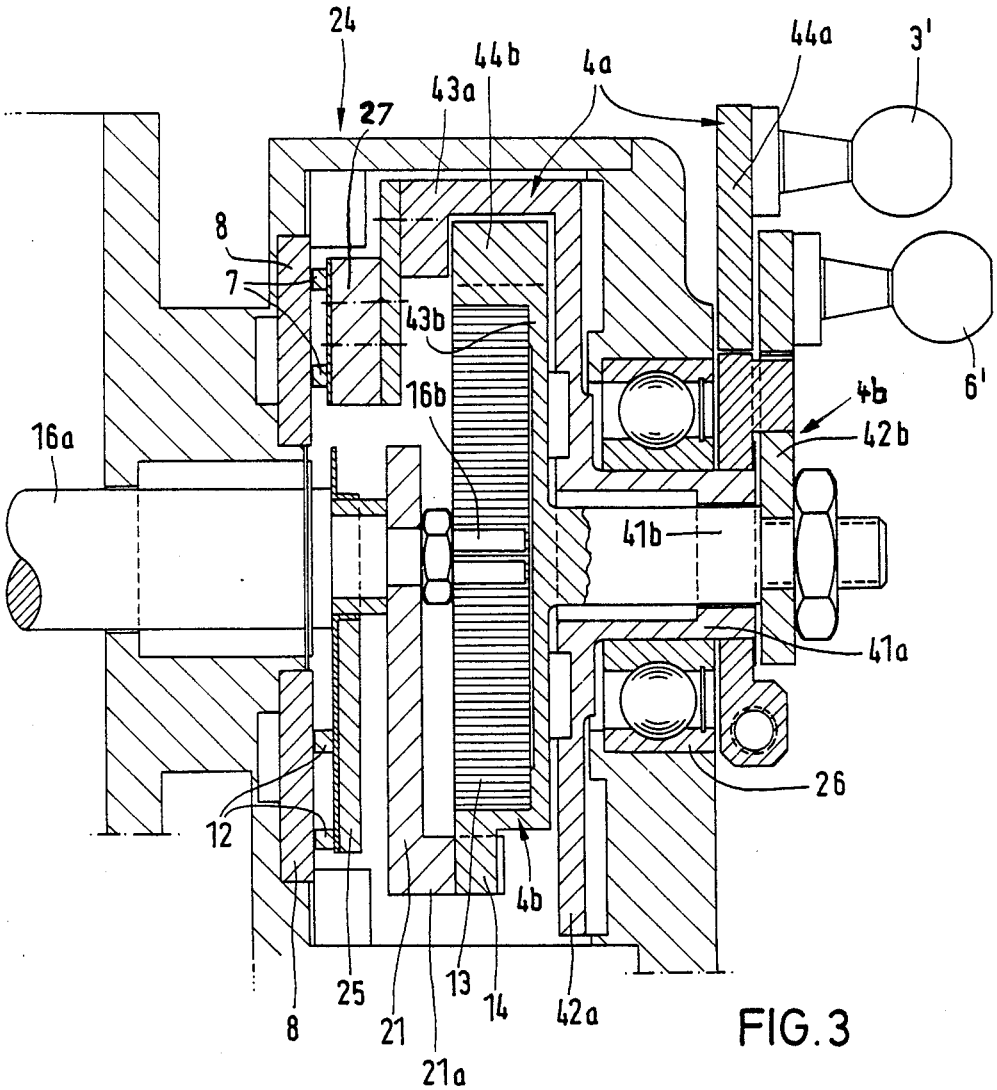
FIG. 3 shows for the variant shown in FIG. 2 of the two-part driver a detailed showing of the structural unit consisting of driver, coupling spring, control element, desired-value detection element and actual-value detection element, said structural unit forming a single unit with the throttle valve housing.

FIG. 3 shows diagrammatically the structural unit which cooperates with the throttle valve (not shown in detail) and consists of the driver parts 4*a* and 4*b*, the coupling spring 13, the control element 11 as well as the wipers 7 and 12. In the merely partially shown throttle valve housing 24 there is first of all the shaft 16*a*, supported on needle bearings, for the throttle valve, which forms a part of the control element 11 and receives, fixed for rotation, the control lever 21 which forms the other part of the control element 11. There is also fastened for rotation to said shaft a wiper arm 25 whose wiper 12 rests against a wiper path (not shown in detail) of the potentiometer 8 associated with said wiper. A bearing borehole in the throttle valve housing 24 receives an antifriction bearing 26 in which the driver part 4*a* is mounted. Said part has a sleeve region 41*a* which is arranged concentrically to the center axis of the shaft 16*a* adjoining which in radial direction on the side facing the shaft 16*a* there is a circular annular region 42*a* which debouches on the outside in a sector 43*a* which extends parallel to the shaft 16*a* and which in the region of its free end has a wiper arm 27 with the wiper 7 which rests on a wiper path of the potentiometer 8, which path is associated with said wiper and has also not been shown in detail. The section of the sleeve 41*a* which extends in the region of the antifriction bearing 26 out of the throttle-valve housing 24 receives, fixed for rotation, a lever 44*a* having a connecting nipple 3' for connection to the rod 3.

Within the sleeve region 41*a* of the driver part 4*a* there is rotatively supported the pin 41*b* of the driver part 4*b*, it receiving in the region of its free end which extends out of the throttle valve housing 24 a lever 42b with connecting nipple 6' on which the return spring 6 acts. The end of the pin 41b facing the shaft 16a debouches at a slight distance from the shaft 16a into a circular annular region 43b which terminates on the outside in an axial ring 44b. Within the ring 44b there is arranged the coupling spring which is developed as a flat spiral spring 13, it surrounding the free end of the shaft 16a facing the pin 41b and having its outer end attached in the region of the driver part 4b surrounding it and its inner end attached in the slotted end 16b of the shaft 16a.

The driver part 4b is finally provided on the outside on the ring 44b with the stop 14 into the path of which a nose 21a arranged on the control lever 21 extends.

FIG. 3 does not show the throttle valve or the facing support region of the throttle valve adjoining same in the throttle valve housing 24. In this region there is arranged the electric servomotor 9 which can be connected via a gearing and the clutch 10 in force-locked manner to the shaft region 16a (not shown) and can thus swing the throttle valve independently of contact of the parts 4a and 4b.

The embodiment shown in FIG. 3, which refers to the block diagram of FIG. 2 with the two-part driver, can be readily transferred to the block diagram 1 having the single-part driver. In order to satisfy the requirements of the block diagram 1, only the driver parts 4a and 4b shown in FIG. 3 would have to be connected in manner fixed for rotation with each other.

We claim:

1. A load setting device for an internal combustion engine of a vehicle, the engine having a setting member which establishes the power of the engine, the device comprising a control element for acting on the setting member;

a driver, an accelerator pedal, an electric actuator, an electronic control device, and a desired-value detection element, the control element being connected to the driver coupled to the accelerator pedal and being furthermore movable by means of the electric actuator; and wherein the desired-value detection element is operative with said driver, the setting device including an acutal-value detection element which cooperates with said desired-value detection element and acts on the electric actuator, the actuator being controllable as a function of signal values detected by the electronic control device; and wherein said device further comprises:

a stop located on the driver;

a coupling spring which interconnects the driver and the control element;

means for biasing the control element in a direction towards said stop of the driver;

a coupling spring; and wherein the driver, the coupling spring, the control element, the desired-value detection element and the actual-value detection element form a single structural unit.

2. A load setting device according to claim 1, wherein the setting member is developed as a throttle valve of the internal combustion engine, and the structural unit forms an assembly with a housing of the throttle valve.

3. A load setting device according to claim 1, further comprising a second spring which urges the driver toward idling position.

4. A load setting device according to claim 1, wherein the coupling spring comprises a coil spring.

5. A load setting device for an internal combustion engine of a vehicle, the engine having a setting member which establishes the power of the engine, the device comprising a control element for acting on the setting member;

a driver, an accelerator pedal, an electric actuator, an electronic control device, and a desired-value detection element, the control element being connected to the driver coupled to the accelerator pedal and being furthermore movable by means of the electric actuator; and wherein the desired-value detection element is operative with said driver, the setting device including an actual-value detection element which cooperates with said desired-value detection element and acts on the electric actuator, the actuator being controllable as a function of signal values detected by the electronic control device; and wherein said device further comprises:

a stop located on the driver;

a coupling spring which interconnects the driver and the control element;

means for biasing the control element in a direction towards said stop of the driver;

a coupling spring; and wherein the control element, as a part thereof, comprises a control lever engageable with said stop; and the driver is developed in two parts, with a first part which is coupled with the accelerator pedal and with the desired-value detection element, and a second part which is movable relative to the first part and carries the stop along a path for engagement with the control lever, the second part being connected to the control element by means of the coupling spring.

6. A load setting device according to claim 5, further comprising a second spring which urges the driver toward idling position; and wherein the second spring acts on the second part of the driver.

7. A load setting device for an internal combustion engine of a vehicle, the engine having a setting member which establishes the power of the engine, the device comprising a control element for acting on the setting member;

a driver, an accelerator pedal, an electric actuator, an electronic control device, and a desired-value detection element, the control element being connected to the driver coupled to the accelerator pedal and being furthermore movable by means of the electric actuator; and wherein the desired-value detection element is operative with said driver, the setting device including an acutal-value detection element which cooperates with said desired-value detection element and acts on the electric actuator, the actuator being controllable as a function of signal values detected by the electronic control device; and wherein said device further comprises:

a stop located on the driver;

a coupling spring which interconnects the driver and the control element;

means for biasing the control element in a direction towards said stop of the driver;

a command and report potentiometer connected to said driver, said potentiometer including a first wiper and a second wiper; and wherein the desired-value detection element is developed as said first wiper, the actual-value detection element is developed as said second wiper and is coupled with the control element, and the distance apart of the wipers is monitored by the electronic control device.

8. A load setting device for an internal combustion engine of a vehicle, the engine having a setting member which establishes the power of the engine, the device comprising a control element for acting on the setting member;

a driver, an accelerator pedal, an electric actuator, an electronic control device, and a desired-value detection element, the control element being connected to the driver coupled to the accelerator pedal and being furthermore movable by means of the electric actuator; and wherein the desired-value detection element is operative with said driver, the setting device including an acutal-value detection element which cooperates with said desired-value detection element and acts on the electric actuator, the actuator being controllable as a function of signal values detected by the electronic control device; and wherein said device further comprises:

a stop located on the driver;

a coupling spring which interconnects the driver and the control element;

means for biasing the control element in a direction towards said stop of the driver; and a pedal contact switch operative by the accelerator pedal.

9. A load setting device for an internal combustion engine of a vehicle, the engine having a setting member which establishes the power of the engine, the device comprising a control element for acting on the setting member;

a driver, an accelerator pedal, an electric actuator, an electronic control device, and a desired-value detection element, the control element being connected to the driver coupled to the accelerator pedal and being furthermore movable by means of the electric actuator; and wherein the desired-value detection element is operative with said driver, the setting device including an acutal-value detection element which cooperates with said desired-value detection element and acts on the electric actuator, the actuator being controllable as a function of signal values detected by the electronic control device; and wherein said device further comprises:

a stop located on the driver;

a coupling spring which interconnects the driver and the control element;

means for biasing the control element in a direction towards said stop of the driver; and wherein said electronic control device is disconnected in a voltage-free state of the load-setting device.

10. A load setting device for an internal combustion engine of a vehicle, the engine having a setting member which establishes the power of the engine, the device comprising a control element for acting on the setting member;

a driver, an accelerator pedal, an electric actuator, an electronic control device, and a desired-value detection element, the control element being connected to the driver coupled to the accelerator pedal and being furthermore movable by means of the electric actuator; and wherein the desired-value detection element is operative with said driver, the setting device including an acutal-value detection element which cooperates with said desired-value detection element and acts on the electric actuator, the actuator being controllable as a function of signal values detected by the electronic control device; and wherein said device further comprises:

a stop located on the driver;

a coupling spring which interconnects the driver and the control element;

means for biasing the control element in a direction towards said stop of the driver; and a clutch, the electric actuator being couplable via the clutch to the control element.

11. A load setting device according to claim 10, wherein the clutch is opened in a deactivated condition of the electric actuator.

12. A load setting device according to claim 11, wherein the electric actuator is controllable as a function of at least one additional control variable.

13. A load setting device for an internal combustion engine of a vehicle, the engine having a setting member which establishes the power of the engine, the device comprising a control element for acting on the setting member;

a driver, an accelerator pedal, an electric actuator, an electronic control device, and a desired-value detection element, the control element being connected to the driver coupled to the accelerator pedal and being furthermore movable by means of the electric actuator; and wherein the desired-value detection element is operative with said driver, the setting device including an acutal-value detection element which cooperates with said desired-value detection element and acts on the electric actuator, the actuator being controllable as a function of signal values detected by the electronic control device; and wherein said device further comprises:

a stop located on the driver;

a coupling spring which interconnects the driver and the control element;

means for biasing the control element in a direction towards said stop of the driver; and a distance monitoring device located between the stop and the control lever, the distance monitoring device upon a predetermined spacing of the electronic control device, feeds a signal for a purpose of testing; and wherein the control element, as a part thereof, comprises a control lever engageable with said stop.

14. A load setting device according to claim 3, wherein the electronic control device disconnects the electric actuator in presence of the signal.

15. A load setting device according to claim 14, further comprising a clutch for disconnection of the electric actuator by electronic control device.

16. A load setting device according to claim 15, further comprising a safety switch electrically connected to the clutch; and wherein the distance monitoring device upon the occurrence of a predetermined distance, opens the safety switch to remove current from the clutch and thereby opens it.

17. A load setting device according to claim 16, wherein the safety contact switch has a bridging line which switches open and close in response to a presence of an additional control variable.

* * * * *